US009687701B1

(12) United States Patent
Seluga et al.

(10) Patent No.: US 9,687,701 B1
(45) **Date of Patent: *Jun. 27, 2017**

(54) WEIGHTED GOLF CLUB HEAD HAVING STRESS-RELIEVING TUBES

(71) Applicant: Callaway Golf Company, Carlsbad, CA (US)

(72) Inventors: James A. Seluga, Carlsbad, CA (US); Matthew Myers, Carlsbad, CA (US); Irina Ivanova, San Marcos, CA (US); Bradley C. Rice, Carlsbad, CA (US); William C. Watson, Temecula, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/279,188

(22) Filed: Sep. 28, 2016

Related U.S. Application Data

(63) Continuation of application No. 14/847,227, filed on Sep. 8, 2015, now Pat. No. 9,486,677, which is a (Continued)

(51) Int. Cl.
*A63B 53/04* (2015.01)
*A63B 53/06* (2015.01)

(52) U.S. Cl.
CPC .... *A63B 53/0466* (2013.01); *A63B 2053/042* (2013.01); *A63B 2053/045* (2013.01);

(Continued)

(58) Field of Classification Search
CPC ..... A63B 53/0466; A63B 53/047; A63B 53/0475; A63B 2053/0491;

(Continued)

(56) References Cited

U.S. PATENT DOCUMENTS 3,652,094 A 3/1972 Glover
5,766,094 A 6/1998 Mahaffey et al.

(Continued)

FOREIGN PATENT DOCUMENTS

JP 01043278 2/1989
JP 3821516 6/2006
JP 2007267777 10/2007

OTHER PUBLICATIONS

Non-Final Office Action dated Feb. 23, 2017, U.S. Appl. No. 15/385,549.

(Continued)

*Primary Examiner* — Sebastiano Passaniti
(74) *Attorney, Agent, or Firm* — Rebecca Hanovice; Michael Catania; Sonia Lari

(57) ABSTRACT

A golf club head comprising a body, an elevated weight bar, and a plurality of carbon tubes is disclosed herein. The body comprises a hollow interior, a face section, a sole section, and a crown section, and the elevated weight bar bridges at least a portion of the sole and may be formed separately from the rest of the body and then affixed to the body by welding or a mechanical fastener. In one embodiment, each of the carbon tubes extends from the crown section and terminates at the elevated weight bar, while in another embodiment each of the carbon tubes extends from the crown section to the sole section and passes through the elevated weight bar without making contact with the floating weight bar.

20 Claims, 13 Drawing Sheets

Related U.S. Application Data continuation-in-part of application No. 14/285,479, filed on May 22, 2014, now Pat. No. 9,211,451, which is a continuation-in-part of application No. 13/788,173, filed on Mar. 7, 2013, now Pat. No. 8,926,448, said application No. 14/847,227 is a continuation-in-part of application No. 14/794,578, filed on Jul. 8, 2015, and a continuation-in-part of application No. 14/788,326, filed on Jun. 30, 2015, now Pat. No. 9,597,558, which is a continuation-in-part of application No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/898,956, filed on Nov. 1, 2013, provisional application No. 61/665,203, filed on Jun. 27, 2012, provisional application No. 61/684,079, filed on Aug. 16, 2012.

(52) U.S. Cl.
CPC ..... *A63B 2053/0408* (2013.01); *A63B 2053/0412* (2013.01); *A63B 2053/0416* (2013.01); *A63B 2053/0491* (2013.01); *A63B 2209/023* (2013.01)

(58) Field of Classification Search
CPC .... A63B 2053/0433; A63B 2053/0412; A63B 2053/045; A63B 2053/0416; A63B 2053/0408; A63B 2209/023; A63B 2053/042
USPC ..... 473/324–350, 287–292, 256
See application file for complete search history.

(56) References Cited

U.S. PATENT DOCUMENTS

| | | | | |
|---|---|---|---|---|
| 6,299,547 | B1 | 10/2001 | Kosmatka | |
| 6,332,847 | B2 | 12/2001 | Murphy et al. | |
| 6,383,090 | B1 | 5/2002 | O'Doherty et al. | |
| 6,435,978 | B1 | 8/2002 | Galloway et al. | |
| 6,475,100 | B1 | 11/2002 | Helmstetter et al. | |
| 6,524,197 | B2 | 2/2003 | Boone | |
| 6,852,038 | B2 | 2/2005 | Yabu | |
| 6,979,270 | B1 | 12/2005 | Allen | |
| 7,066,835 | B2 | 6/2006 | Evans et al. | |
| 7,108,609 | B2 | 9/2006 | Stites et al. | |
| 7,166,041 | B2 | 1/2007 | Evans | |
| 7,351,161 | B2 | 4/2008 | Beach | |
| 7,387,579 | B2 | 6/2008 | Lin et al. | |
| 7,445,563 | B1 | 11/2008 | Werner | |
| 7,691,006 | B1 | 4/2010 | Burke | |
| 7,914,393 | B2 | 3/2011 | Hirsch et al. | |
| 8,257,195 | B1 * | 9/2012 | Erickson | A63B 53/0466 473/329 |
| 8,328,661 | B1 * | 12/2012 | Erickson | A63B 53/0466 473/329 |
| 8,414,420 | B1 * | 4/2013 | Erickson | A63B 53/0466 473/329 |
| 8,425,346 | B1 * | 4/2013 | Erickson | A63B 53/0466 473/329 |
| 8,523,702 | B2 | 9/2013 | Thomas et al. | |
| 8,540,587 | B2 | 9/2013 | Hirsch et al. | |
| 8,591,352 | B2 | 11/2013 | Hirano | |
| 8,608,585 | B2 | 12/2013 | Stites et al. | |
| 8,663,027 | B2 | 3/2014 | Morales et al. | |
| 8,690,708 | B1 * | 4/2014 | Ehlers | A63B 53/0466 473/337 |
| 8,834,293 | B2 | 9/2014 | Thomas et al. | |
| 8,834,294 | B1 * | 9/2014 | Seluga | A63B 53/04 473/338 |
| 8,900,070 | B1 * | 12/2014 | Dawson | A63B 53/047 473/329 |
| 8,926,448 | B1 * | 1/2015 | Ivanova | A63B 53/047 473/329 |
| 8,956,244 | B1 * | 2/2015 | Westrum | 473/338 |
| 9,022,881 | B1 * | 5/2015 | Ehlers | A63B 53/06 473/335 |
| 9,067,110 | B1 * | 6/2015 | Seluga | A63B 53/06 |
| 9,072,951 | B1 * | 7/2015 | Tang | A63B 53/06 |
| 9,079,078 | B2 | 7/2015 | Greensmith et al. | |
| 9,101,811 | B1 * | 8/2015 | Goudarzi | A63B 53/0466 |
| 9,180,349 | B1 * | 11/2015 | Seluga | A63B 53/04 |
| 9,211,451 | B1 * | 12/2015 | Westrum | A63B 53/047 |
| 9,211,453 | B1 * | 12/2015 | Foster | A63B 53/06 |
| 9,216,332 | B1 * | 12/2015 | Ehlers | A63B 53/06 |
| 9,259,627 | B1 * | 2/2016 | Myers | A63B 53/04 |
| 9,333,390 | B1 * | 5/2016 | Manwaring | A63B 24/0003 |
| 9,345,936 | B1 * | 5/2016 | Westrum | A63B 53/04 |
| 9,352,199 | B2 * | 5/2016 | Seluga | A63B 53/06 |
| 9,409,069 | B2 * | 8/2016 | Ehlers | A63B 53/06 |
| 9,463,361 | B2 * | 10/2016 | Goudarzi | A63B 53/0466 |
| 9,486,677 | B1 * | 11/2016 | Seluga | A63B 53/0466 |
| 9,586,105 | B1 * | 3/2017 | Westrum | A63B 53/047 |
| 9,597,558 | B1 * | 3/2017 | Seluga | A63B 53/0466 |
| 9,597,561 | B1 * | 3/2017 | Seluga | A63B 53/0466 |
| 2010/0304887 | A1 | 12/2010 | Bennett et al. | |
| 2010/0331101 | A1 | 12/2010 | Sato et al. | |
| 2015/0165280 | A1 | 6/2015 | Hebreo | |

OTHER PUBLICATIONS

Final Office Action dated Feb. 21, 2017, U.S. Appl. No. 14/794,578.
Final Office Action dated Feb. 21, 2017, U.S. Appl. No. 14/997,199.
Final Office Action dated Mar. 24, 2017, U.S. Appl. No. 15/063,107.
Non-Final Office Action dated Jun. 28, 2016, U.S. Appl. No. 15/013,052.
Non-Final Office Action dated Jun. 29, 2016, U.S. Appl. No. 14/794,578.
Non-Final Office Action dated Apr. 21, 2016, U.S. Appl. No. 14/794,578.
Non-Final Office Action dated Jan. 14, 2016, U.S. Appl. No. 14/794,578.
Non-Final Office Action dated Jun. 28, 2016, U.S. Appl. No. 15/011,313.
Non-Final Office Action dated Jul. 12, 2016, U.S. Appl. No. 14/997,199.
Non-Final Office Action dated Jul. 11, 2016, U.S. Appl. No. 15/063,107.
Non-Final Office Action dated Jul. 22, 2016, U.S. Appl. No. 15/051,361.
Non-Final Office Action dated Dec. 1, 2016, U.S. Appl. No. 15/005,875.
Non-Final Office Action dated Apr. 17, 2017, U.S. Appl. No. 15/447,638.
Non-Final Office Action dated Apr. 17, 2017, U.S. Appl. No. 15/446,754.

* cited by examiner

WEIGHTED GOLF CLUB HEAD HAVING STRESS-RELIEVING TUBES

CROSS REFERENCES TO RELATED APPLICATIONS

The present application is a continuation of U.S. patent application Ser. No. 14/847,227, filed on Sep. 8, 2015, which is a continuation-in-part of U.S. patent application Ser. No. 14/285,479, filed on May 22, 2014, and issued on Dec. 15, 2015, as U.S. Pat. No. 9,211,451, which is a continuation-in-part of U.S. patent application Ser. No. 13/788,173, filed on Mar. 7, 2013, and issued on Jan. 6, 2015, as U.S. Pat. No. 8,926,448, and also is a continuation-in-part of U.S. patent application Ser. No. 14/794,578, filed on Jul. 8, 2015, and also is a continuation-in-part of U.S. patent application Ser. No. 14/788,326, filed on Jun. 30, 2015, which is a continuation-in-part of U.S. patent application Ser. No. 14/755,068, filed on Jun. 30, 2015, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which claims priority to U.S. Provisional Patent Application No. 61/898,956, filed on Nov. 1, 2013, and which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application Nos. 61/665,203, filed on Jun. 27, 2012, and 61/684,079, filed on Aug. 16, 2012.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with composite tubes intersecting a weight feature.

Description of the Related Art

The prior art discloses various golf club heads having interior structures. For example: Yabu, U.S. Pat. No. 6,852,038 for a Golf Club Head And Method of Making The Same, discloses a golf club head with a sound bar; Galloway, U.S. Pat. No. 7,118,493 for a Multiple Material Golf Club Head discloses a golf club head with a composite aft body having an interior sound component extending upward from a sole section of a metal face component; Seluga et al., U.S. Pat. No. 8,834,294 for a Golf Club Head With Center Of Gravity Adjustability discloses a golf club head with a tube having a mass for adjusting the CG of a golf club head; and Dawson et al., U.S. Pat. No. 8,900,070 for a Weighted Golf Club Head discloses a golf club head with an interior weight lip extending from the sole towards the face.

However, the prior art fails to disclose an interior structure that increases ball speed while reducing stress in the face at impact, with a minimal increase in mass to the golf club head.

BRIEF SUMMARY OF THE INVENTION

The inventive golf club head comprises a weight bar proximate the face and bridging at least a portion of the sole, and a plurality of interior carbon tubes extending at least partially through the weight bar. In some embodiments, at least one of the carbon tubes connects the sole to the crown and thereby reduces the stress in a face during impact with a golf ball. In a further embodiment, the carbon tubes connecting the sole to the crown do not make contact with the weight bar.

One aspect of the present invention is a golf club head with carbon tubes. The golf club head includes a body, a face component and carbon tubes. The body comprises a sole section, a crown section, a front section having an opening, and a protrusion extending from a heel side of the body to a toe side of the body over at least a portion of the sole section and towards the front section. The face component is positioned over the opening. Each of the carbon tubes extends from the crown section to the protrusion.

Another aspect of the present invention is a fairway wood-type golf club head comprising a body, a face component and carbon tubes. The body comprises a sole section having a protrusion extending upward and forward, a crown section and a front section having an opening. The body is composed of a first metal material. The face component is positioned over the opening. The face component is composed of a second metal material. The face component comprises a striking plate portion and a return portion. Each of the carbon tubes extends from the crown section to the protrusion.

Yet another aspect of the present invention is a golf club head comprising a body comprising a sole section, a crown section, a front section having an opening, a hollow interior, and an elevated weight bar extending from a heel side of the sole section to a toe side of the sole section and bridging a central area of the sole section, a face component positioned over the opening, and a plurality of carbon tubes, each of the plurality of carbon tubes extending from the crown section to the elevated weight bar, wherein none of the plurality of carbon tubes contacts the sole section, and wherein the elevated weight bar and each of the plurality of carbon tubes are disposed within the hollow interior proximate the front section. The plurality of carbon tubes may range from two carbon tubes to eight carbon tubes, or it may comprise three carbon tubes, each of which may be spaced no less than 12 millimeters and no more than 25 millimeters from an adjacent carbon tube. In some embodiments, each of the plurality of carbon tubes may have a diameter ranging from 2 millimeters to 5 millimeters and a length ranging from 30 millimeters to 60 millimeters. In other embodiments, each of the plurality of carbon tubes may be within 11 millimeters of an interior surface of a striking plate of the face component.

In some embodiments, the crown section may comprise a plurality of apertures, each of which may correspond to a carbon tube of the plurality carbon tubes, and the elevated weight bar may comprise a plurality of bores, each of which may correspond to a carbon tube of the plurality carbon tubes. In other embodiments, the golf club head may have a volume ranging from 100 cubic centimeters to 300 cubic centimeters. In still other embodiments, each of the plurality of carbon tubes may be positioned rearward from an interior surface of a striking plate section of the face component a distance ranging from 2 millimeters to 11 millimeters. In some embodiments, the body may be composed of an iron alloy.

Another aspect of the present invention is a golf club head comprising a body comprising a sole section, a crown section, a front section having an opening, a hollow interior, and an elevated weight bar extending from a heel side of the sole section to a toe side of the sole section and bridging a central area of the sole section, a face component positioned over the opening, and a plurality of carbon tubes, each of the plurality of carbon tubes extending from the crown section to the sole section, wherein the elevated weight bar comprises a plurality of through-bores, wherein each of the plurality of carbon tubes extends through one of the plurality of through-bores to contact the sole section, and wherein the elevated weight bar and each of the plurality of carbon tubes are disposed within the hollow interior proximate the front section. The elevated weight bar may be formed separately from the body and then be welded to the sole section. In some embodiments, the crown section may comprise a first plurality of apertures, each of which may correspond to a carbon tube of the plurality carbon tubes, and the sole section may comprise a second plurality of apertures, each of which may correspond to a carbon tube of the plurality carbon tubes. In some embodiments, none of the plurality of carbon tubes may make contact with the elevated weight bar.

In some embodiments, the face component may comprise at least one return section and a striking plate section, and each of the plurality of carbon tubes may be within 11 millimeters of an interior surface of the striking plate section. In other embodiments, the golf club head may comprise a plurality of bosses, each of which may correspond to an aperture of the first and second pluralities of apertures. In some embodiments, the golf club head may be a wood-type golf club head, and each of the plurality of carbon tubes may be spaced a distance of at least 12 millimeters and no more than 25 millimeters from an adjacent carbon tube.

Yet another aspect of the present invention is a fairway wood-type golf club head comprising a steel body comprising a sole section, a crown section, a front section having an opening, a hollow interior, and an elevated weight bar extending from a heel side of the sole section to a toe side of the sole section and bridging a central area of the sole section, a steel face component positioned over the opening, the face component comprising a striking plate section and at least one return section, and at least three carbon tubes, each of the carbon tubes extending from the crown section to the sole section and positioned rearward from an interior surface of the striking plate section a distance of no less than 2 millimeters and no more than 11 millimeters, wherein the elevated weight bar comprises at least three through-bores, wherein each of the carbon tubes extends through one of the through-bores to contact the sole section, wherein none of the carbon tubes contacts the elevated weight bar, wherein the elevated weight bar and each of the plurality of carbon tubes are disposed within the hollow interior proximate the front section, and wherein the elevated weight bar is welded to the sole section.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
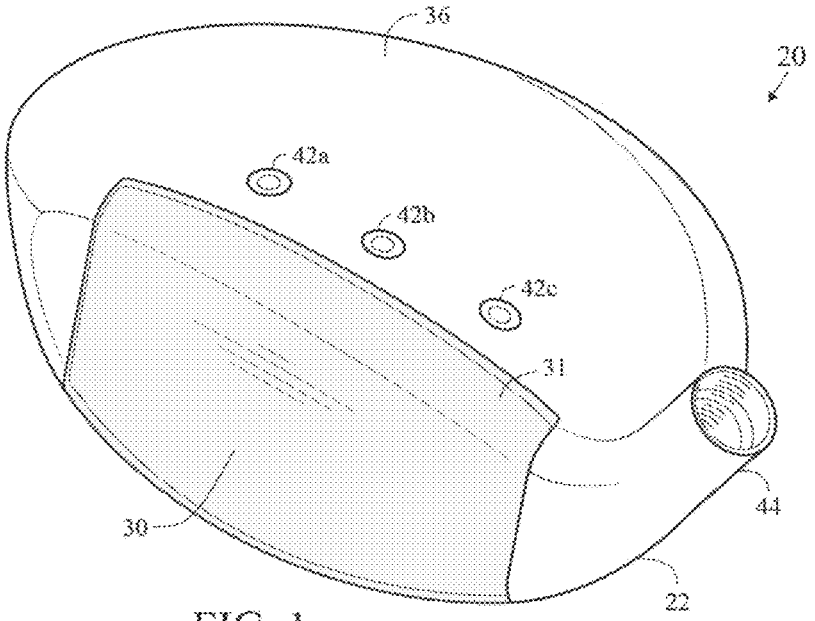
FIG. 1 is a top perspective view of a first golf club head with composite tubes.
Figure 2:
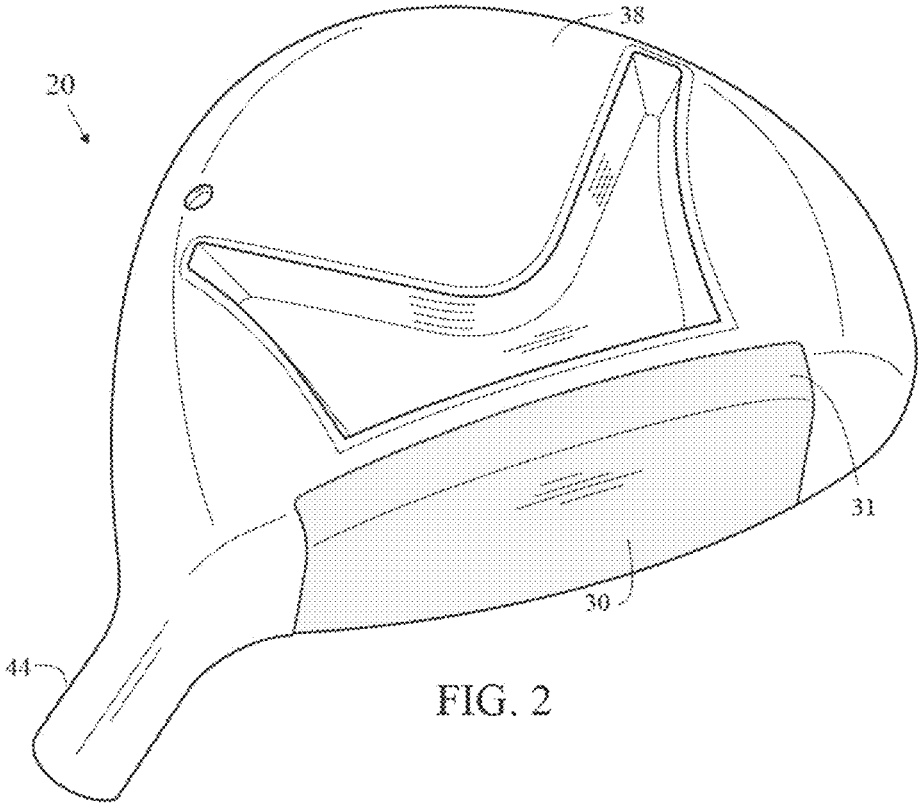
FIG. 2 is a sole perspective view of the golf club head shown in FIG. 1.
Figure 3:
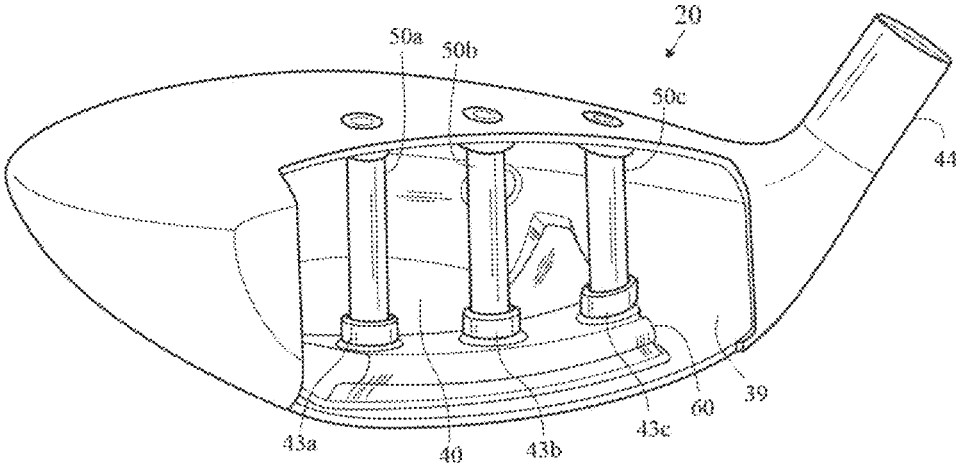
FIG. 3 is a front perspective view of the golf club head shown in FIG. 1 with the face component removed to illustrate an interior.
Figure 4:
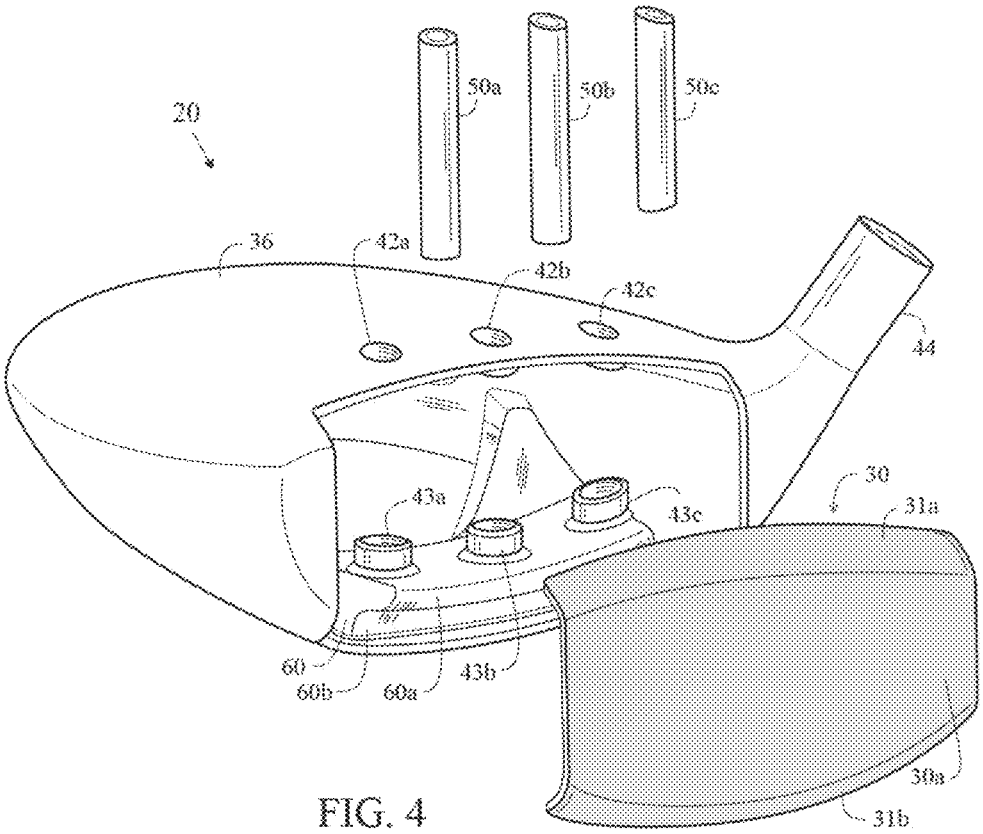
FIG. 4 is an exploded view of the golf club head shown in FIG. 1.
Figure 5:
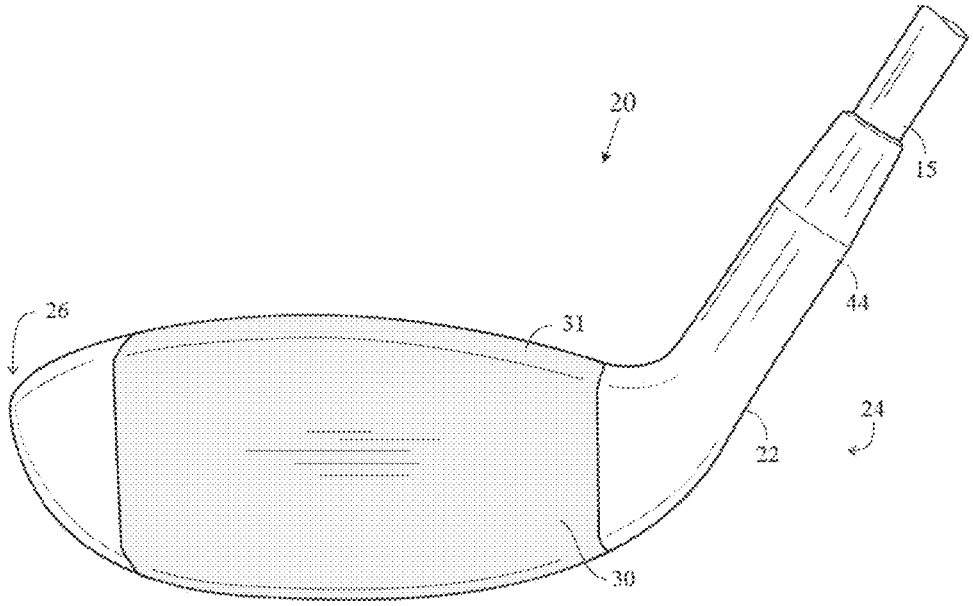
FIG. 5 is a front elevation view of the golf club head shown in FIG. 1.
Figure 6:
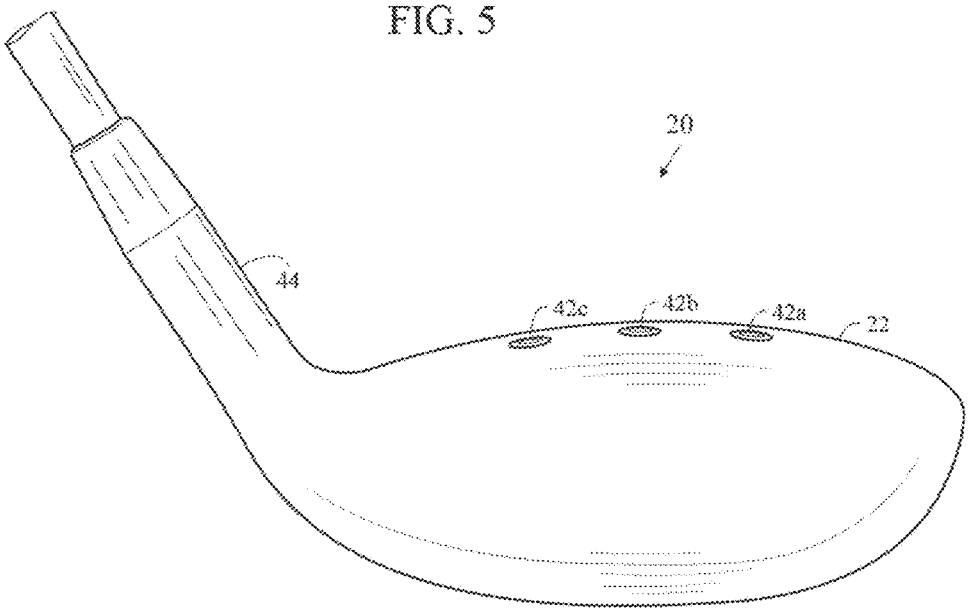
FIG. 6 is a rear elevation view of the golf club head shown in FIG. 1.
Figure 7:
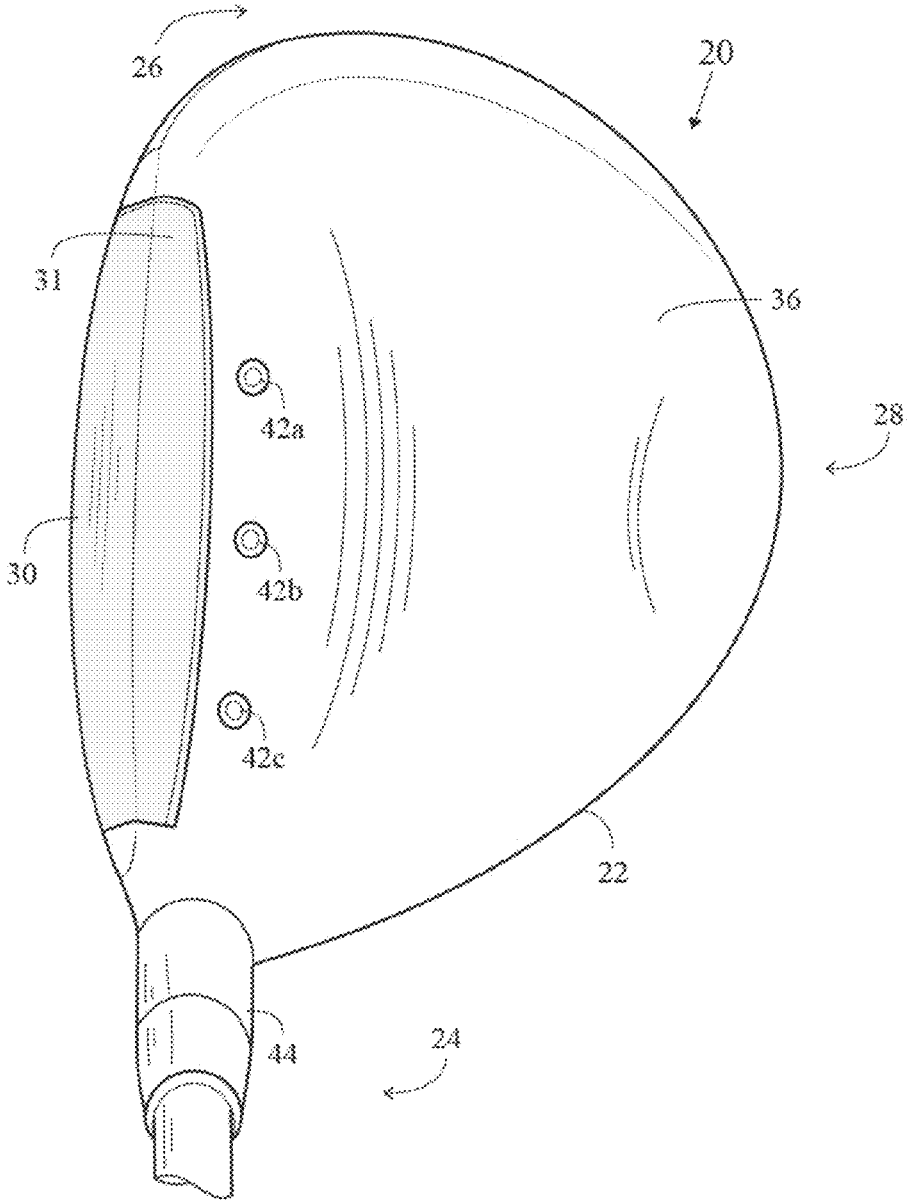
FIG. 7 is a top plan view of the golf club head shown in FIG. 1.
Figure 8:
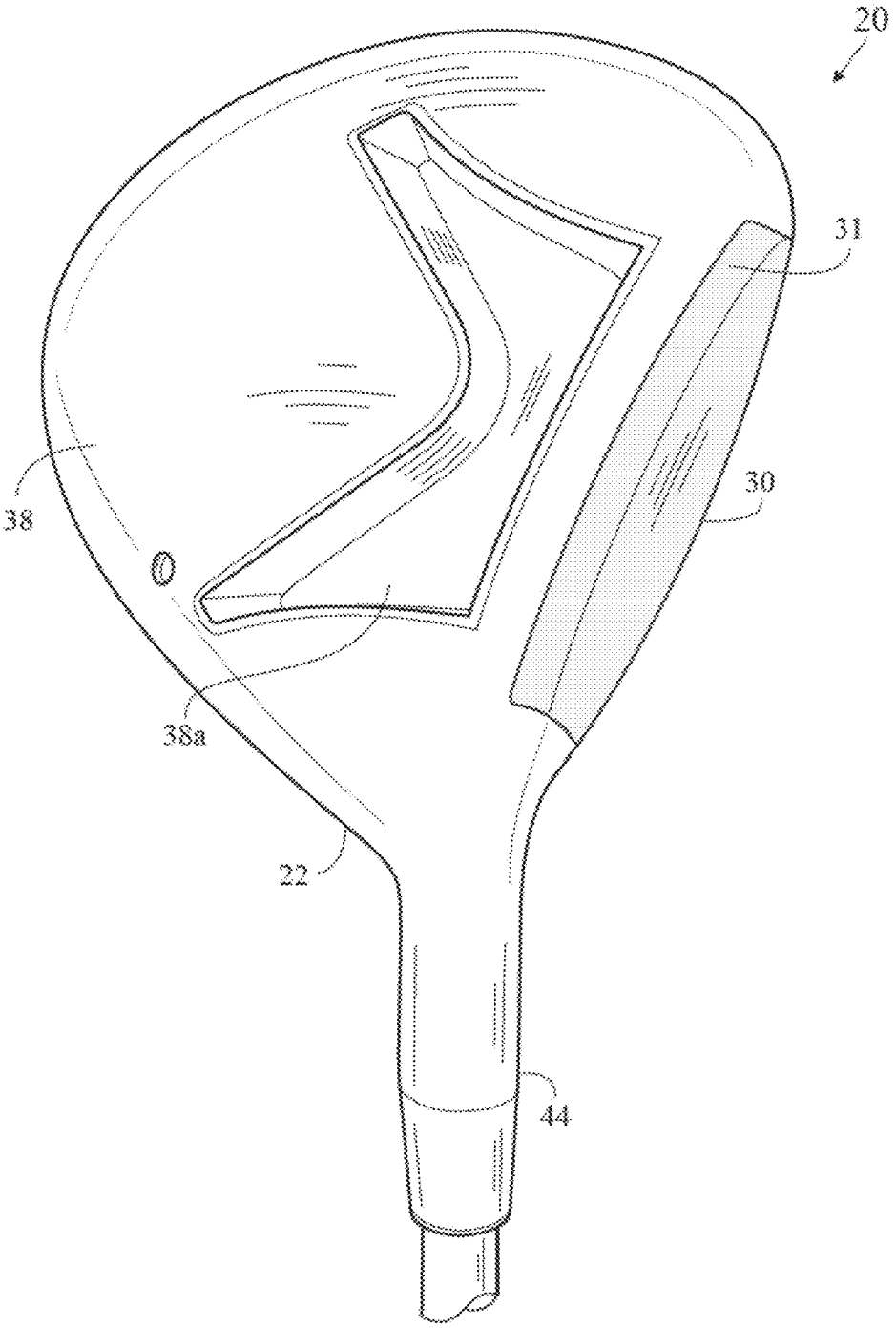
FIG. 8 is a sole perspective view of the golf club head shown in FIG. 1 engaged with a shaft.
Figure 9:
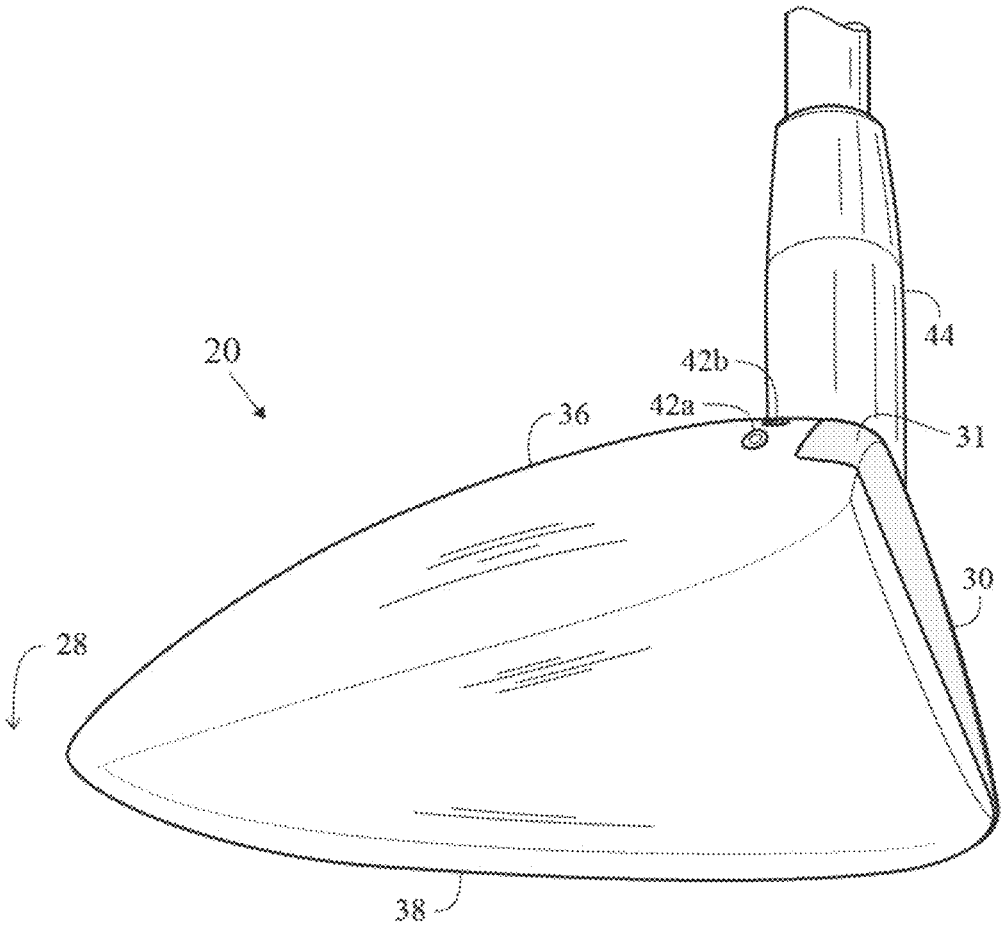
FIG. 9 is a side elevation view of the golf club head shown in FIG. 1.
Figure 10:
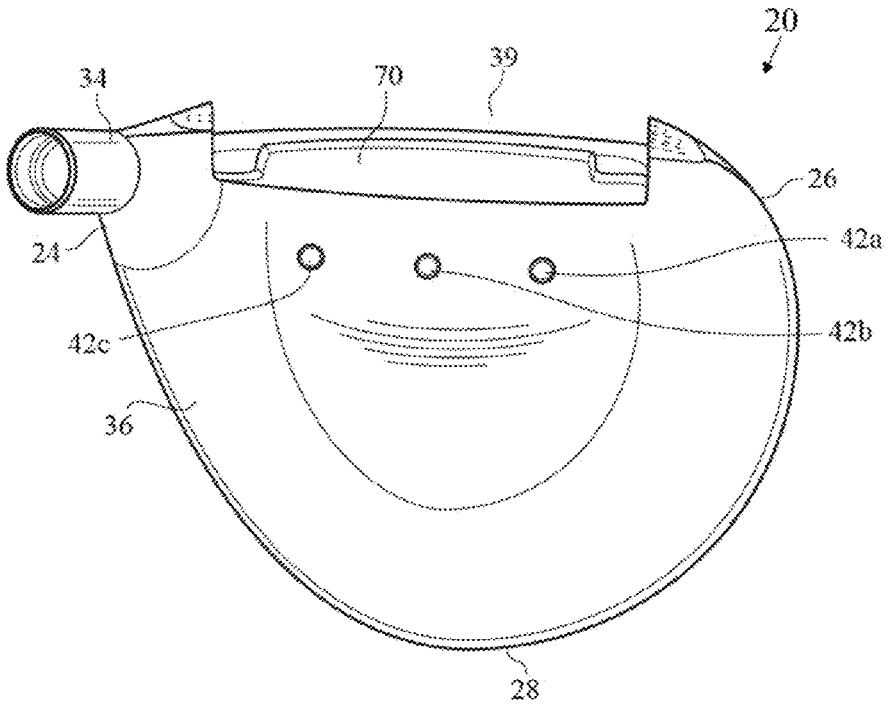
FIG. 10 is a top plan view of a second golf club head with composite tubes with the face component removed.
Figure 11:
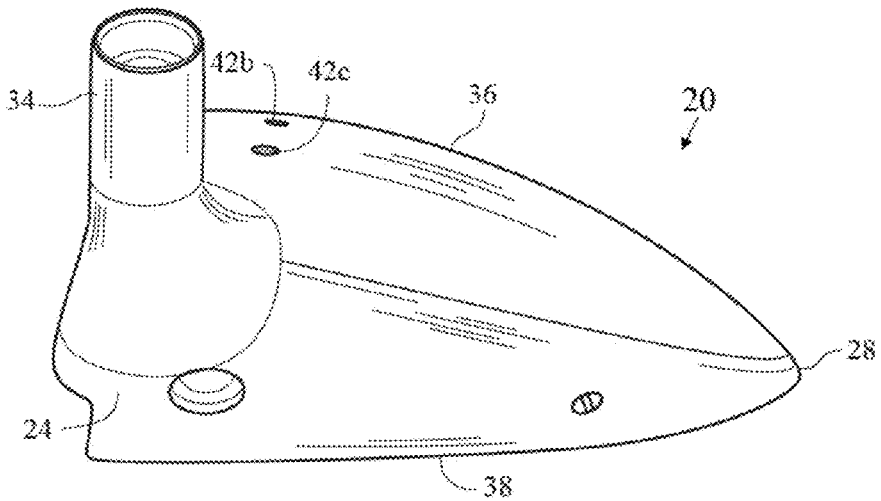
FIG. 11 is a side elevation view of the golf club head shown in FIG. 10.
Figure 12:
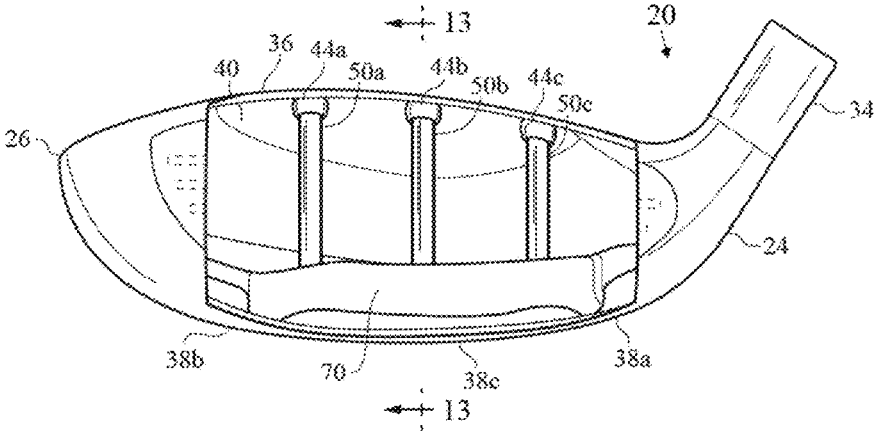
FIG. 12 is a front elevation view of the golf club head shown in FIG. 10.

As shown in FIGS. 1-9, a golf club head is generally designated 20. The golf club head 20 preferably includes a body 22 having a hosel 34, a crown section 36, a sole section 38 with a protrusion 60, a heel end 24, a toe end 26, and an aft end 28. A face component 30 is placed over an opening 39 in the body 22. The body 22, along with the face component 30, preferably defines a hollow interior 40. Within the hollow interior 40, multiple carbon tubes 50 extend from the protrusion 60 of the sole section 38 upward to the crown section 36.

The plurality of carbon tubes 50 preferably ranges from two carbon tubes to eight carbon tubes. Each of the plurality of carbon tubes 50 preferably has a diameter ranging from 2 millimeters to 5 millimeters. Each of the plurality of carbon tubes 50 preferably has a length ranging from 30 millimeters to 60 millimeters. Each of the plurality of carbon tubes 50 is preferably positioned within 11 millimeters of an interior surface of the face component 30. The mass of each of the plurality of carbon tubes 50 preferably ranges from 0.5 gram to 3 grams, more preferably from 1 gram to 2 grams, and most preferably each carbon tube 50 has a mass of 1.5 grams. The crown section 36 preferably comprises a plurality of apertures 42 with bosses 44 extending therefrom for support. Each of the plurality of apertures 42*a*, 42*b*, 42*c* and their respective bosses 44*a*, 44*b*, 44*c* preferably corresponds to a carbon tube 50*a*, 50*b*, 50*c* of the plurality of carbon tubes 50. The sole section 38 preferably comprises a plurality of bosses 43*a*, 43*b*, 43*c* each of which preferably corresponds to a carbon tube 50*a*, 50*b*, 50*c* of the plurality of carbon tubes 50. The carbon tubes 50*a*, 50*b*, 50*c* preferably are glued into the bosses 43*a*, 43*b*, 43*c*.

The face component 30 preferably comprises a striking plate section 30*a* and return sections 31*a* and 31*b* that are approximately perpendicular to the striking plate section 30*a*. The face component 30 is preferably welded over the opening 39 of the body 22. The face component 30 is preferably composed of a metal that is different than the metal of the body 22. The face component 30 is preferably composed of a high performance metal material such as SP700 titanium alloy, carpenter steel, or the like. The face component 30 preferably has a varying thickness, which may be the varying thickness described in U.S. Pat. No. 7,448,960, for a Golf Club Head With Variable Face Thickness, which pertinent parts are hereby incorporated by reference. Other alternative embodiments of the thickness of the face component 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the face section has a uniform thickness.

In order to achieve a low, frontward center of gravity (CG) without affecting a weld seam, the protrusion 60 is located inside the hollow interior 40 and proximate the opening 39. This construction avoids creating welding problems, but still allows for discretionary mass to be located mostly low and forward in the golf club head 20. The protrusion 60 preferably has a base section 60*b* and an extension section 60*a*. The carbon tubes 50 are positioned on the extension section 60*a* of the protrusion 60. The protrusion 60, which preferably is cast into the body 22 but may, in alternative embodiments, be welded or affixed mechanically to the body 22, extends upwards from the sole section 38 and protrudes from the opening of the body 22. When the golf club head 20 is assembled, the protrusion 60 extends towards the face component 30 without making contact with the striking plate section 30*a*. The protrusion 60 preferably comprises at least 20% of the mass of the body 22, and more preferably 30% of the mass of the body 22. The protrusion 60 preferably ranges in mass from 30 grams to 60 grams. U.S. Pat. No. 8,414,420 for a Weighted Golf Club Head to Erickson is hereby incorporated by reference in its entirety herein.

Figure 13:
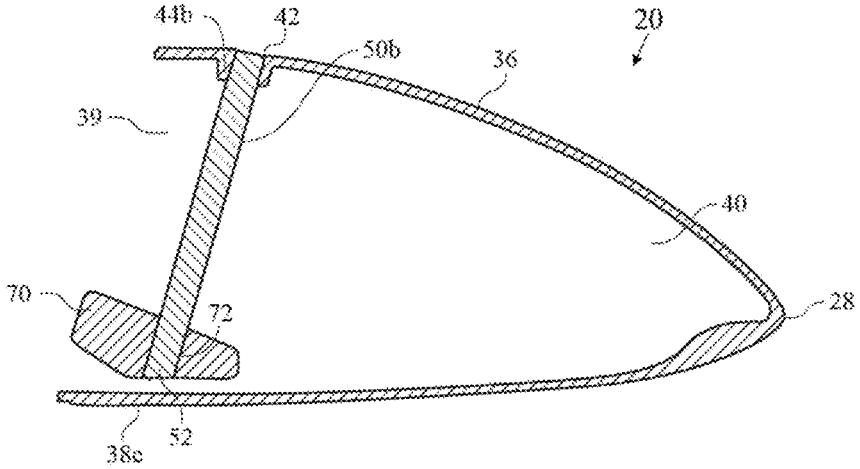
FIG. 13 is a cross-sectional view of the golf club head shown in FIG. 12 along lines 13-13.
Figure 14:
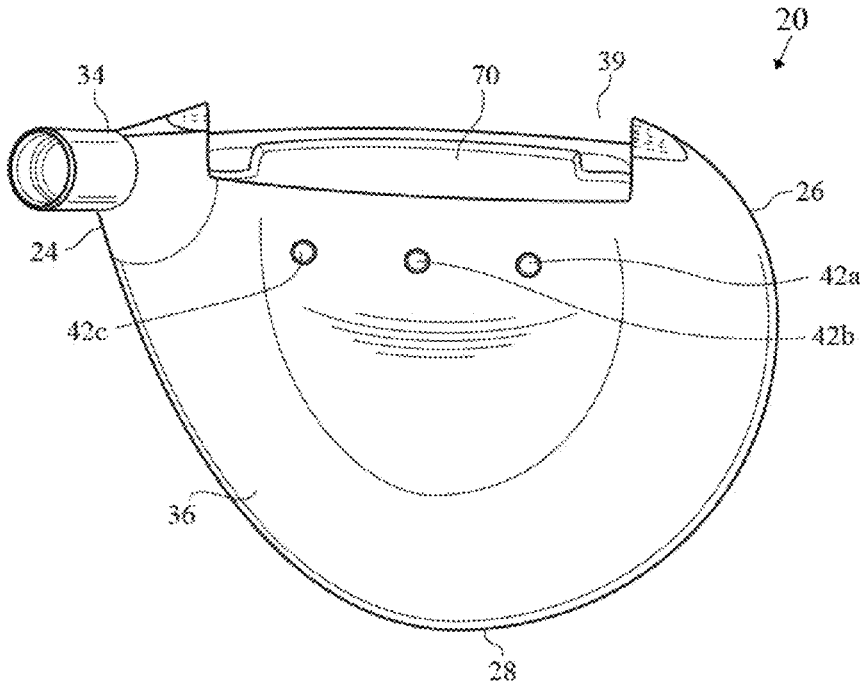
FIG. 14 is a top plan view of a third golf club head with composite tubes with the face component removed.
Figure 15:
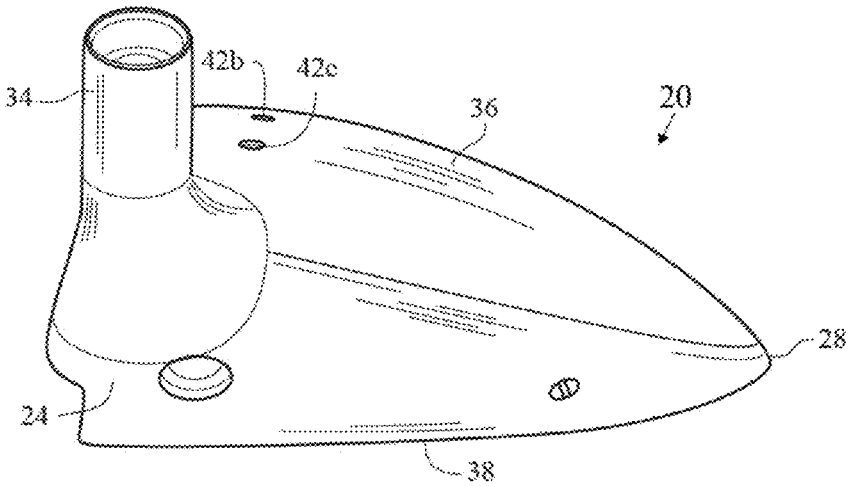
FIG. 15 is a side elevation view of the golf club head shown in FIG. 14.
Figure 16:
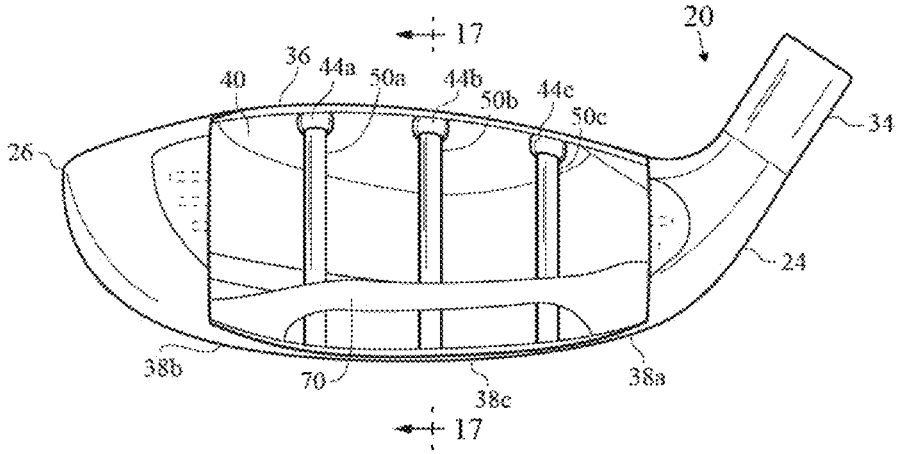
FIG. 16 is a front elevation view of the golf club head shown in FIG. 14.
Figure 17:
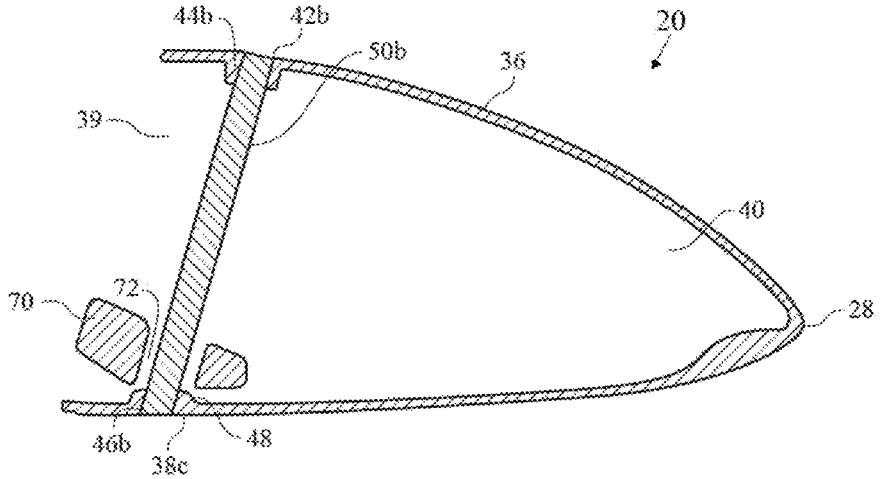
FIG. 17 is a cross-sectional view of the golf club head shown in FIG. 16 along lines 17-17.
Figure 18:
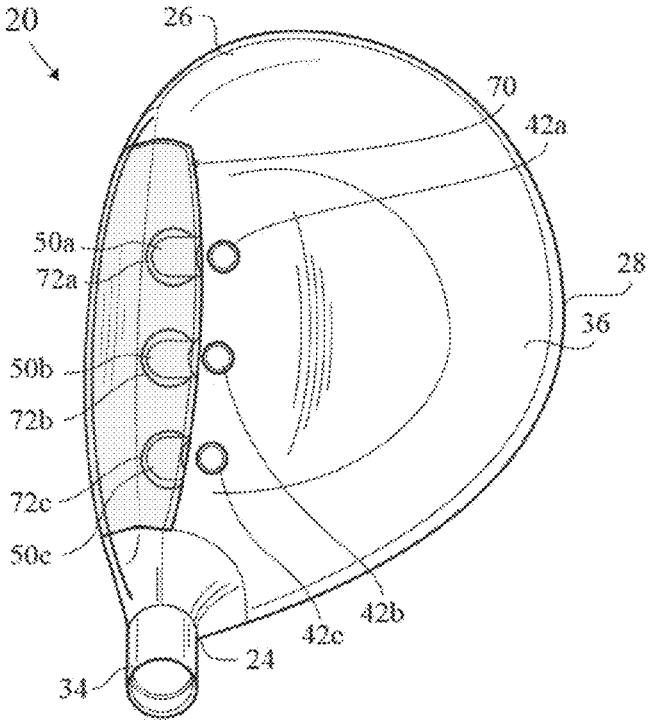
FIG. 18 is a top plan, partially transparent view of the golf club head shown in FIG. 14 with the face component attached.
Figure 19:
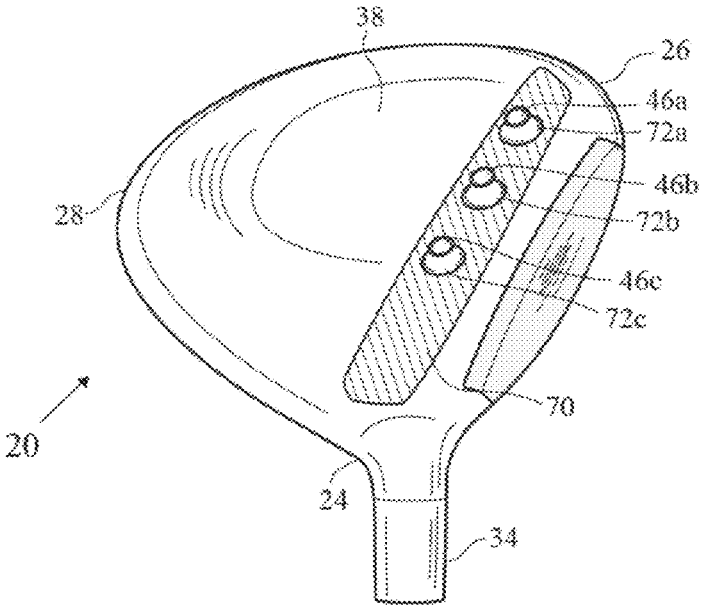
FIG. 19 is a sole elevation, partially transparent view of the golf club head shown in FIG. 18.
Figures 20, 21:
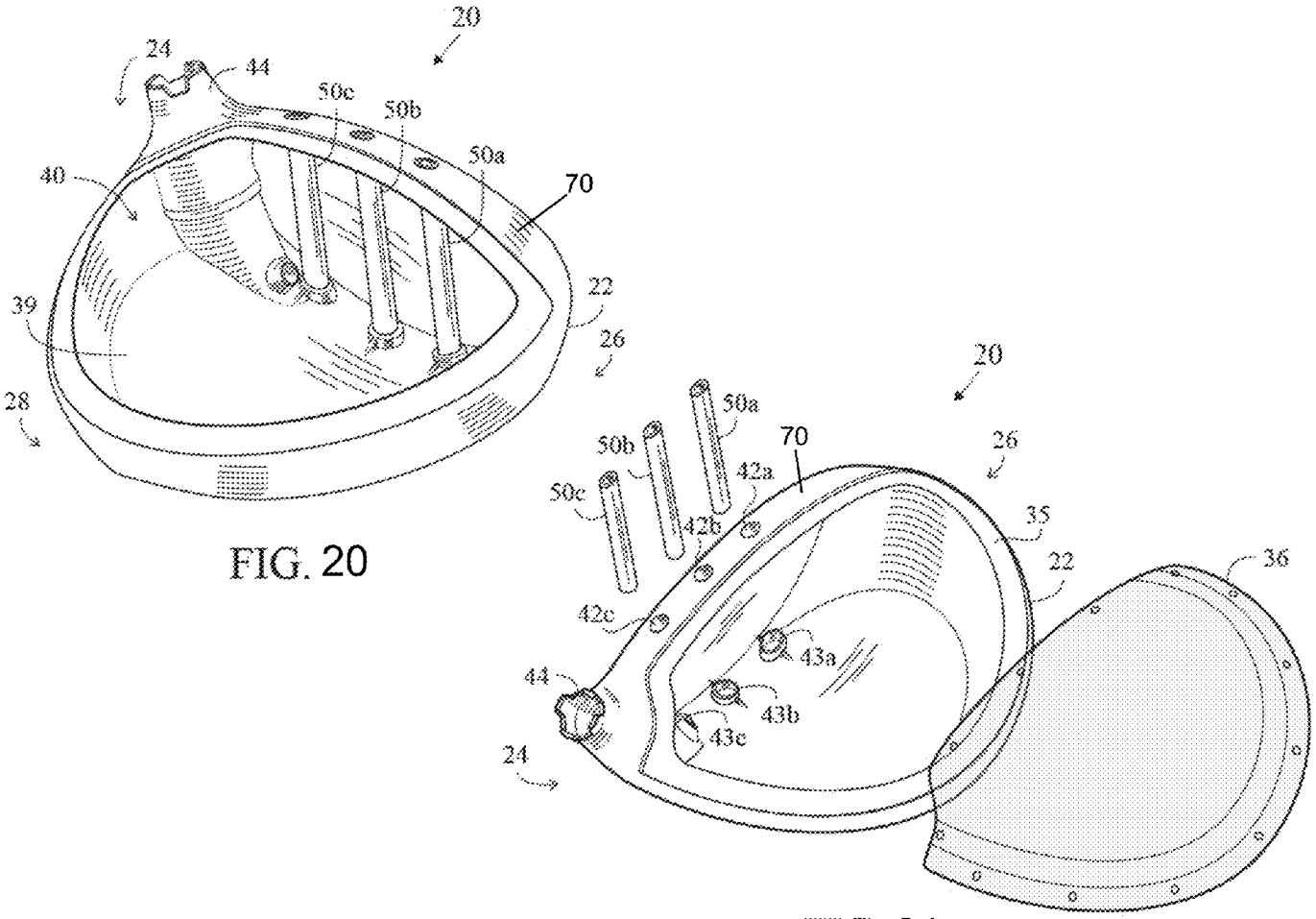
FIG. 20 is a top perspective view of a fourth golf club head with a crown section removed to illustrate an interior.
FIG. 21 is a top perspective exploded view of the golf club head shown in FIG. 20.
Figure 22:
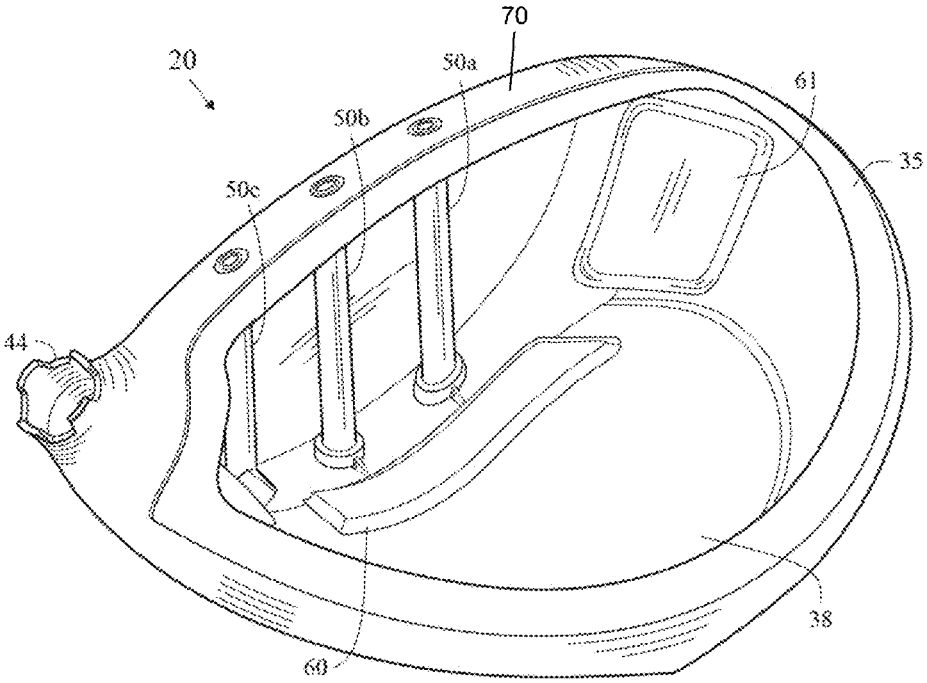
FIG. 22 is a top perspective view of the golf club head shown in FIG. 21 with a crown section removed to illustrate an interior.
Figure 23:
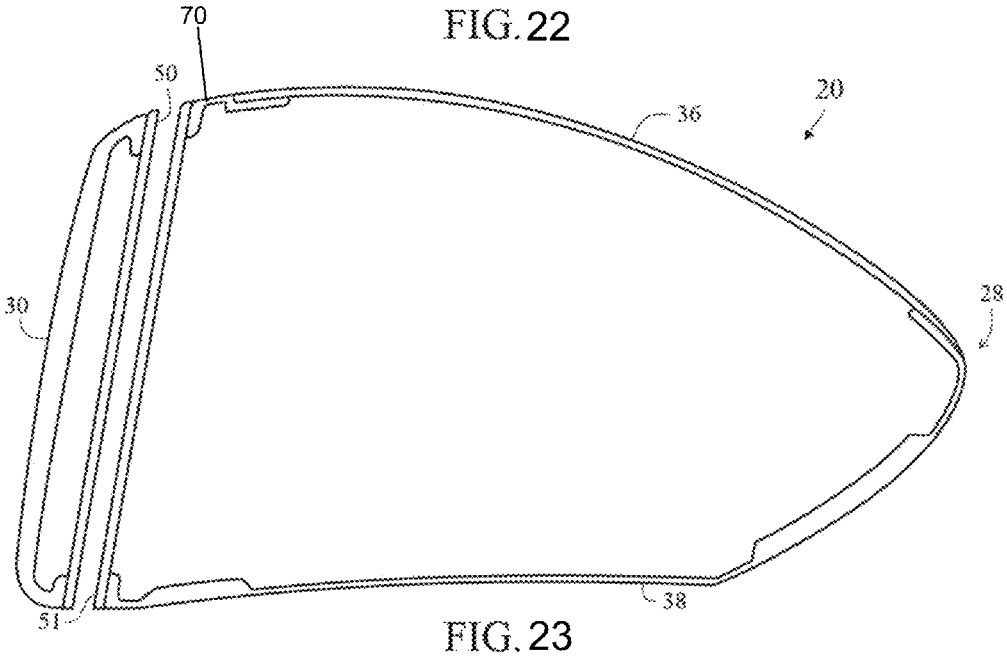
FIG. 23 is a cross-sectional view of the golf club head shown in FIG. 21 when fully assembled.

In an alternative, preferred embodiment, shown in FIGS. 10-13, the golf club head 20 has all of the same features as the embodiment shown in FIGS. 1-9, except that the body 22 includes an elevated weight bar 70 that extends from a heel portion 38*a* to a toe portion 38*b* of the sole section 38, and bridges a central area 38*c* of the sole proximate the opening 39. The elevated weight bar 70 includes a plurality of through-bores 72*a*, 72*b*, 72*c* that line up with the apertures 42*a*, 42*b*, 42*c* in the crown section 36 and that receive the lower ends 52 of the carbon tubes 50*a*, 50*b*, 50*c*. Though the through-bores 72 do not include bosses 43 in this embodiment, bosses 43 may be included in an alternative embodiment. As shown in FIG. 13, the lower ends 52 of the carbon tubes 50*a*, 50*b*, 50*c* preferably are entirely contained within the through-bores 72 and do not extend into the space between the elevated weight bar 70 and the central area 38*c* of the sole section 38.

During impact, and at least partially due to the thin, lightweight materials used to make crowns, flexible areas of the crown section 36 are known to change launch and backspin in the same outer mold line (OML), particularly high on the striking plate section 30*a*. In this preferred embodiment, the carbon tubes 50 do not touch any portion of the sole section 38, but provide support for the crown section 36 and constrain the crown section 36 from its typical movement. This concentrates as much of the movement as possible in the sole section 38, which can move only because of the elevated weight bar 70. In another embodiment, the golf club head 20 may also include a slot 80 extending into the sole section 38 proximate the elevated weight bar 70, like the one shown in FIGS. 2 and 8, to further allow the sole section 38 to flex.

In yet another embodiment of the present invention, shown in FIGS. 14-19, the golf club head 20 has all of the same elements as the preferred embodiment, except that the carbon tubes 50*a*, 50*b*, 50*c* extend completely through the through-bores 72 of the elevated weight bar 70 to connect the crown section 36 with the sole section 38. In this embodiment, the carbon tubes 50*a*, 50*b*, 50*c* preferably do not make contact with any portion of the elevated weight bar 70, so the through-bores 72 preferably have larger diameters in this embodiment than in the preferred embodiment. Each carbon tube 50*a*, 50*b*, 50*c* extends from an aperture 42*a*, 42*b*, 42*c* in the crown section 36, through a through-bore 72*a*, 72*b*, 72*c*, and into an aperture 46*a*, 46*b*, 46*c* in the sole section 38. As shown in the Figures, each set of apertures 42*a*, 42*b*, 42*c*, 46*a*, 46*b*, 46*c* and through-bores 72*a*, 72*b*, 72*c* is aligned vertically so that the carbon tubes 50*a*, 50*b*, 50*c* do not need to be bent to extend through them. Each aperture 46 in the sole section 38 also has a boss 48 to better support the carbon tube 50 engaged with that aperture 46.

In the embodiments shown in FIGS. 11-19, the elevated weight bar 70 may be integrally cast with the body 22, but preferably is manufactured separately from the body 22 and is welded or mechanically affixed to the sole section 38. In any of the embodiments disclosed herein, the carbon tubes 50 may be placed in tension or in compression between the crown and sole sections 36, 38 or the crown section 36 and the protrusion 60 or elevated weight bar 70.

In the embodiment shown in FIGS. 20-23, the golf club head 20 includes a body 22 having a sole section 38, a face section 30, a return section 70, a heel end 24, a toe end 26 and an aft end 28. A crown section 36 is placed on an opening 39 in the body 22, the opening 39 defined by the sole section 38 and return section 70. The body section 22, along with the crown section 36, defines a hollow interior 40, within which multiple carbon tubes 50 extend from the sole section 38 upward to the return section 70. The plurality of carbon tubes 50 ranges from two carbon tubes to eight carbon tubes, and each of the plurality of carbon tubes 50 has a diameter ranging from 2 millimeters to 5 millimeters. Each of the plurality of carbon tubes 50 has a length ranging from 30 millimeters to 60 millimeters and is positioned within 11 millimeters of an interior surface of the face section 30. The mass of each of the plurality of carbon tubes 50 ranges from 0.5 gram to 3 grams, more preferably from 1 gram to 2 grams, and most preferably each carbon tube 50 has a mass of 1.5 grams.

The return section 70 preferably comprises a plurality of apertures 42, each of which corresponds to a carbon tube 50 of the plurality carbon tubes 50. The sole section 38 preferably comprises a plurality of bosses 43, each of which corresponds to a carbon tube 50 of the plurality carbon tubes 50. The carbon tubes 50 are preferably glued into the bosses 50.

The high weight pads 60 and 61 have a mass ranging from 5 grams to 50 grams, more preferably from 10 grams to 30 grams, and most preferably from 15 grams to 25 grams. The high weight pads 60 and 61 are composed of a material that has a density ranging from 5 grams per cubic centimeters to 20 grams per cubic centimeters, more preferably from 7 grams per cubic centimeters to 12 grams per cubic centimeters. The high weight pads 60 and 61 are composed of a polymer material integrated with a metal material, which is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyurethane. A preferred high weight pad 60 is an injection molded thermoplastic polyurethane integrated with tungsten to have a density of 8.0 grams per cubic centimeters. In an alternative embodiment, the high weight pad 60 is composed of from 50 to 95 volume percent polyurethane and from 50 to 5 volume percent tungsten. Also, in an alternative embodiment, the high weight pad 60 is composed of from 10 to 25 weight percent polyurethane and from 90 to 75 weight percent tungsten. The placement of the high weight pads 60 allow for the moment of inertia of the golf club head to be optimized.

In each of the embodiments disclosed herein, the body 22 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 22 is composed of 17-4 steel alloy. Additional methods for manufacturing the body 22 include forming the body 22 from a flat sheet of metal, super-plastic forming the body from a flat sheet of metal, machining the body 22 from a solid block of metal, electrochemical milling the body 22 from a forged pre-form, casting the body using centrifugal casting, casting the body 22 using levitation casting, and like manufacturing methods.

The embodiments of the golf club head 20 disclosed herein, when designed as a driver, preferably have a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. The volume of the golf club heads 20 will also vary between fairway woods (preferably ranging from 3-woods to eleven woods) with smaller volumes than drivers.

The golf club heads 20 disclosed herein, when designed as a driver, preferably have a mass no more than 215 grams, and most preferably a mass of 180 to 215 grams. When the golf club heads 20 are designed as a fairway wood, the golf club heads 20 preferably have a mass of 135 grams to 200 grams, and preferably from 140 grams to 165 grams. In some embodiments, the golf club head 20 has a volume of 460 cubic centimeters with the Characteristic Time (CT) of the face close to, but not exceeding, the 257 microsecond ("O") limit set by the USGA.

In other embodiments, the golf club head 20 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf club head comprising:

a body comprising a sole section, a crown section, a front section having an opening, a hollow interior, and an elevated weight bar extending from a heel side of the sole section to a toe side of the sole section and bridging a central area of the sole section;

a face component positioned over the opening; and a plurality of tubes, each of the plurality of tubes extending from the crown section to the elevated weight bar, wherein none of the plurality of tubes contacts the sole section, wherein each of the plurality of tubes is spaced no less than 12 millimeters and no more than 25 millimeters from an adjacent tube, wherein each of the plurality of tubes has a diameter ranging from 2 millimeters to 5 millimeters, wherein each of the plurality of tubes has a length ranging from 30 millimeters to 60 millimeters, wherein each of the plurality of tubes is disposed within 11 millimeters of an interior surface of a striking plate of the face component wherein the elevated weight bar and the plurality of tubes are disposed within the hollow interior proximate the front section.

2. The golf club head according to claim 1, wherein the plurality of tubes ranges from two tubes to eight tubes.

3. The golf club head according to claim 1, wherein the crown section comprises a plurality of apertures, wherein each of the plurality of apertures corresponds to a tube of the plurality of tubes, wherein the elevated weight bar comprises a plurality of bores, and wherein each of the plurality of bores corresponds to a tube of the plurality of tubes.

4. The golf club head according to claim 1 wherein the golf club head has a volume ranging from 100 cubic centimeters to 300 cubic centimeters.

5. The golf club head according to claim 1 wherein the body is composed of an iron alloy.

6. A golf club head comprising:

a body comprising a sole section, a crown section, a front section having an opening, a hollow interior, and an elevated weight bar extending from a heel side of the sole section to a toe side of the sole section and bridging a central area of the sole section;

a face component positioned over the opening; and a plurality of tubes, each of the plurality of tubes extending from the crown section to the sole section, wherein the face component comprises a striking plate section comprising an interior surface facing the hollow interior, wherein the elevated weight bar comprises a plurality of through-bores, wherein each of the plurality of tubes extends through one of the plurality of through-bores to contact the sole section, wherein none of the plurality of tubes contacts the elevated weight bar, wherein each of the plurality of tubes is disposed within 11 millimeters of the interior surface of the striking plate section, and wherein the elevated weight bar and the plurality of tubes are disposed within the hollow interior proximate the front section.

7. The golf club head according to claim 6, wherein the elevated weight bar is formed separately from the body.

8. The golf club head according to claim 7, wherein the elevated weight bar is welded to the sole section.

9. The golf club head according to claim 6, wherein the crown section comprises a first plurality of apertures, wherein each of the first plurality of apertures corresponds to a tube of the plurality of tubes, wherein the sole section comprises a second plurality of apertures, and wherein each of the second plurality of apertures corresponds to a tube of the plurality of tubes.

10. The golf club head according to claim 9, further comprising a plurality of bosses, wherein each of the plurality of bosses corresponds to an aperture of the first and second pluralities of apertures.

11. The golf club head according to claim 6, wherein the face component comprises at least one return section extending away from the striking plate section.

12. The golf club head according to claim 6, wherein the golf club head is a wood-type golf club head.

13. The golf club head according to claim 6, wherein each of the plurality of tubes is spaced a distance of at least 12 millimeters and no more than 25 millimeters from an adjacent tube.

14. A wood-type golf club head comprising:

a body comprising a face section, a sole section, and a return section, the sole section and return section defining an upper opening in the body;

a crown section disposed on the body to close the upper opening and define a hollow interior of the golf club head; and a plurality of tubes positioned within the hollow interior of the golf club head, each of the plurality of tubes extending from the return section to the sole section, wherein the plurality of tubes comprises first, second, and third tubes, wherein each of the plurality of tubes is positioned rearward from an interior surface of the face section a distance ranging from 2 millimeters to 11 millimeters, wherein each of the plurality of tubes has a diameter ranging from 2 millimeters to 5 millimeters and a length ranging from 30 millimeters to 60 millimeters, wherein the return section comprises a plurality of apertures, wherein each of the plurality of apertures corresponds to one of the plurality of tubes, wherein the sole section comprises a plurality of bosses, and wherein each of the plurality of bosses corresponds to one of plurality of tubes.

15. The wood-type golf club head of claim 14, wherein the golf club head has a volume ranging from 200 cubic centimeters to 475 cubic centimeters.

16. The wood-type golf club head of claim 15, wherein the body is composed of a material selected from the group consisting of steel and titanium alloy.

17. The wood-type golf club head of claim 14, wherein each of the plurality of tubes is spaced a distance of at least 12 millimeters and no more than 25 millimeters from an adjacent tube.

18. The wood-type golf club head of claim 14, wherein the golf club head is a driver.

19. The wood-type golf club head of claim 14, wherein the body is cast from titanium alloy.

20. The wood-type golf club head of claim 19, wherein the crown is composed of carbon composite.

* * * * *